United States Patent [19]

Woerwag

[11] 4,370,777

[45] Feb. 1, 1983

[54] ELECTRIC MOTOR CONTROL FOR VACUUM CLEANER

[75] Inventor: Peter Woerwag, Stuttgart, Fed. Rep. of Germany

[73] Assignee: Duepro AG, Romanshorn, Switzerland

[21] Appl. No.: 211,353

[22] Filed: Nov. 28, 1980

[30] Foreign Application Priority Data

Nov. 28, 1979 [DE] Fed. Rep. of Germany ..... 2947994

[51] Int. Cl.[3] ..... A47L 9/00

[52] U.S. Cl. ..... 15/339

[58] Field of Search ..... 15/339, 319, 377

[56] References Cited

U.S. PATENT DOCUMENTS

| | | | |
|---|---|---|---|
| 3,579,706 | 5/1971 | Hetland | 15/377 X |
| 3,588,943 | 6/1971 | Hetland | 15/377 X |
| 3,636,285 | 1/1972 | Wickham et al. | 15/339 X |
| 3,855,665 | 12/1974 | Schwartz | 15/339 |

*Primary Examiner*—Chris K. Moore

*Attorney, Agent, or Firm*—Schwartz, Jeffery, Schwaab, Mack, Blumenthal & Koch

[57] ABSTRACT

Disclosed is an improvement in a vacuum cleaner having a roller-shaped brush mounted in the vacuum nozzle thereof. A separate rotational speed control is provided for the electric motor which operates the roller-shaped brush and in preferred embodiments this rotational speed control is adjustable by the operator of the vacuum cleaner. In a further embodiment, two separate rotational speed controls are provided, one controlling the speed of the roller-brush motor and the other controlling the speed of the vacuum-generating motor. A still further embodiment comprises a single rotational speed control which can be interchangeably switched into or out of connection with either the roller-brush motor or the vacuum-generating motor. A still further embodiment discloses a roller-brush motor speed control which can be added to existing vacuum cleaners.

5 Claims, 6 Drawing Figures

ELECTRIC MOTOR CONTROL FOR VACUUM CLEANER

BACKGROUND OF THE INVENTION

The present invention relates generally to electric motor powered vacuum cleaners and specifically to the motor control of an electric vacuum cleaner which has a separate electric motor powered rotary brush.

Vacuum cleaners are known which have a roller-shaped brush which is rotatingly mounted in the nozzle opening of the vacuum cleaner. The brush may be driven by a motor mounted in the housing of the brush device by means of a belt drive. Electrical energy required for running the electric motor is obtained by means of a connecting line to the circuit of the vacuum-generating motor with both motors being operated together. Both motors, connected in parallel, are generally connected to an electrical power supply (house current) by a power line.

In these prior art brush-equipped vacuum cleaners, the drive motor and thus the brush itself is operated only at a single rotational rate.

The use of the roller-shaped brush device in combination with the vacuum cleaner on textile floor coverings of different types makes it necessary to adjust the rpm of the roller-shaped brush to the particular type of floor covering in order to achieve optimum cleaning performance. These different floor coverings also lead to widely differing loads on the brush with the long-pile "shag" carpet presenting a substantially greater load to the brush motor than does a shorter-pile or "cut-pile" floor covering.

SUMMARY OF THE INVENTION

It is an object of the present invention to maintain the vacuum-generating motor of a vacuum cleaner at its highest power setting while controlling the roller-shaped brush motor at an rpm which is most suited to the material being cleaned. In accordance with the above and other objects, a separate rotational speed setting device is provided for the roller-brush motor to control its operation. This device may be a variable resistance connected in series with the roller-brush motor which changes the voltage applied across the motor. In a further embodiment, there may be two rpm-setting devices, one connected to the vacuum-generating motor and the other connected to the roller-shaped brush motor. In this embodiment, the suction as well as the roller-shaped brush rotation can be independently set in order to achieve an optimum cleaning result. In a further embodiment, a single rpm setting device can be provided with a selector switch which enables the operator of the vacuum cleaner to vary the rotational rate of the vacuum-generating motor, the roller-shaped brush motor, or both motors together. A further embodiment includes a modification for existing appliances so as to permit independent control of the rotational speed of the roller-brush motor.

A more complete appreciation of the invention and the attendant advantages therof will be more clearly understood by reference to the folowing drawings wherein.

DETAILED DESCRIPTION OF PREFERRED EMBODIMENTS

Figure 1:
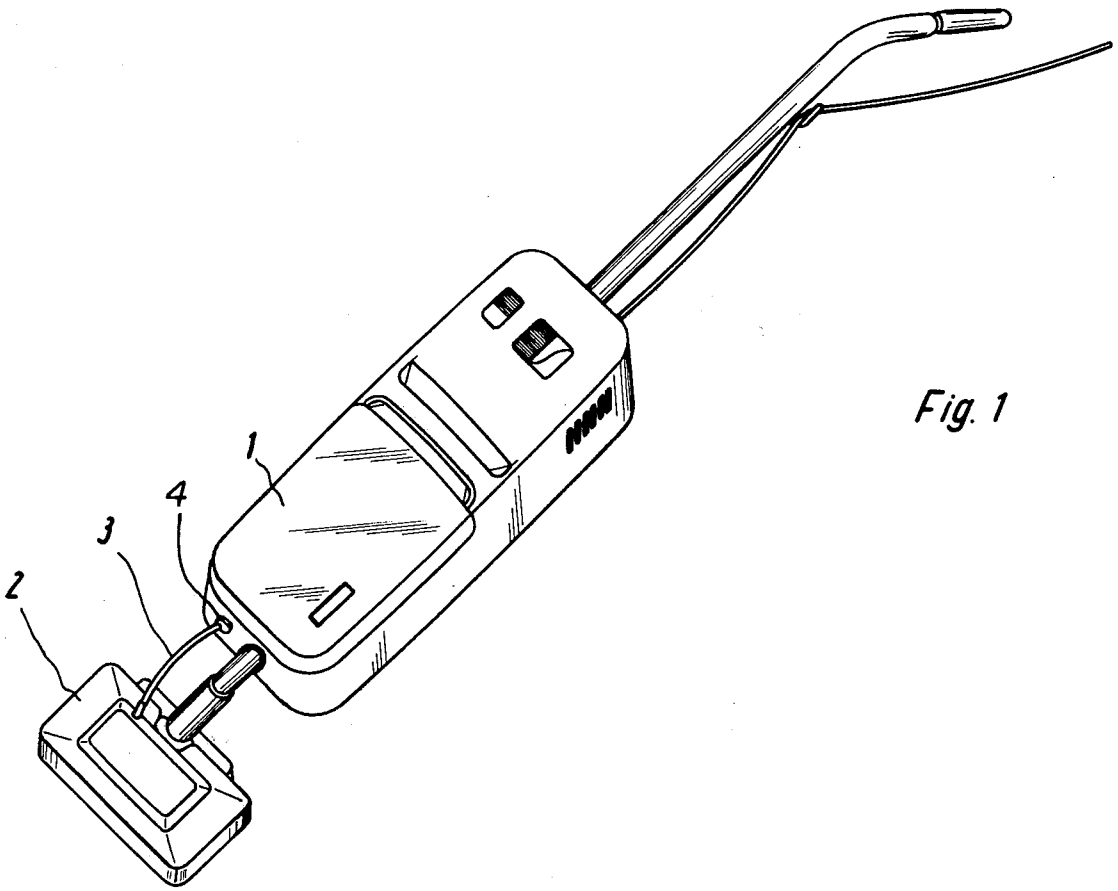
FIG. 1 is a perspective view of a vacuum cleaner having a roller-brush device attached thereto.
Figure 2:
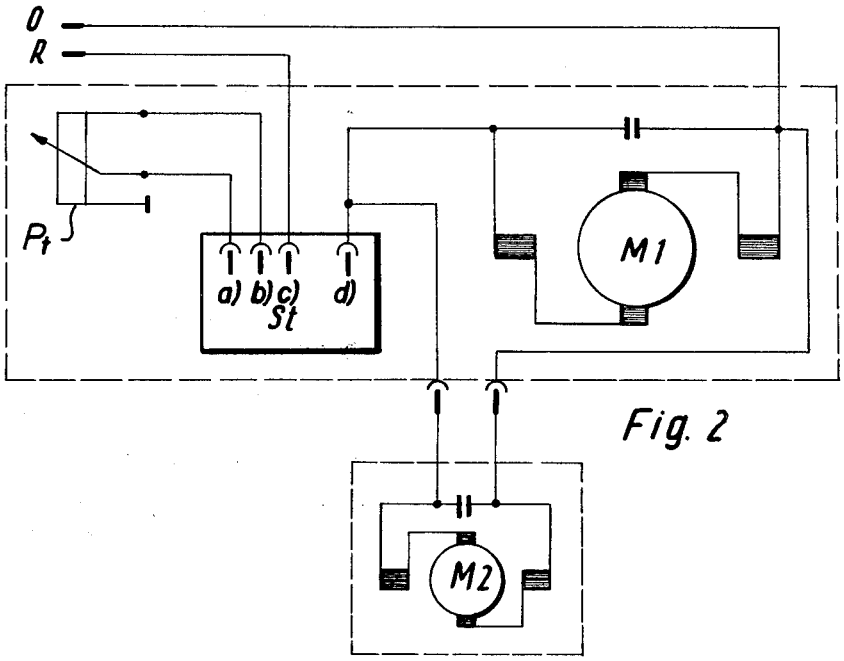
FIG. 2 is an electrical schematic showing the vacuum-generating motor connected in parallel with the roller-brush motor and both motors in series with an rpm-setting device.
Figure 3:
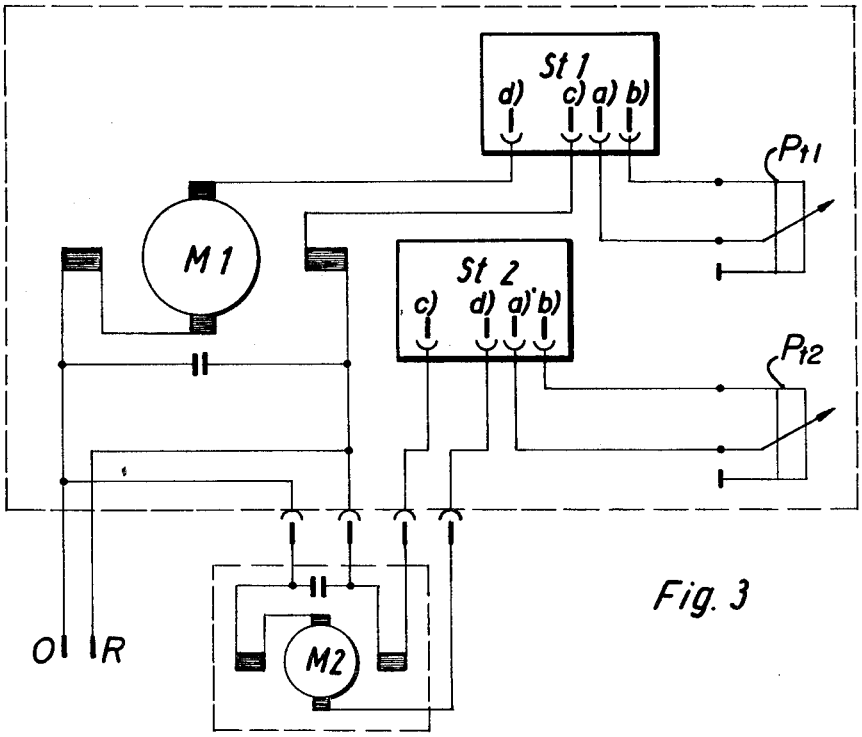
FIG. 3 is an electrical schematic depicting separate rpm-setting devices for each of the vacuum-generating and roller-brush motors.

Referring now to the drawings, wherein like reference characters designate like parts throughout the several views, FIG. 1 shows simplified representation of a vacuum cleaner 1 with an added cleaning tool in the form of a brush device 2 which is supplied with electrical energy by means of a plug connection 4 and wire 3 from the vacuum cleaner. FIG. 2 illustrates an rpm-setting means St, which is connected to an input supply voltage at terminals O and R. The rpm-setting means is responsive to the adjustment of control Pt which may be a potentiometer. At the control output of the rpm-setting means St the vacuum-generating motor M1 and the roller-brush motor M2 are connected in parallel and thus movement of control Pt will result in a change in the rotational rate of both motors. A further embodiment to the present invention is illustrated in FIG. 3 wherein a first rpm-setting means St1 is connected in series with the vacuum-generating motor M1 and a second rpm-setting means St2 is connected in series with the roller-shaped brush motor M2. The rpm-setting means St1 and St2 are controlled by manual control devices Pt1 and Pt2. In this embodiment, the operator can control the rotational speed of both the vacuum-generating motor and the rotating-brush motor and can tailor the vacuum cleaner's operation to the precise requirements of the floor covering being cleaned.

Figure 4:
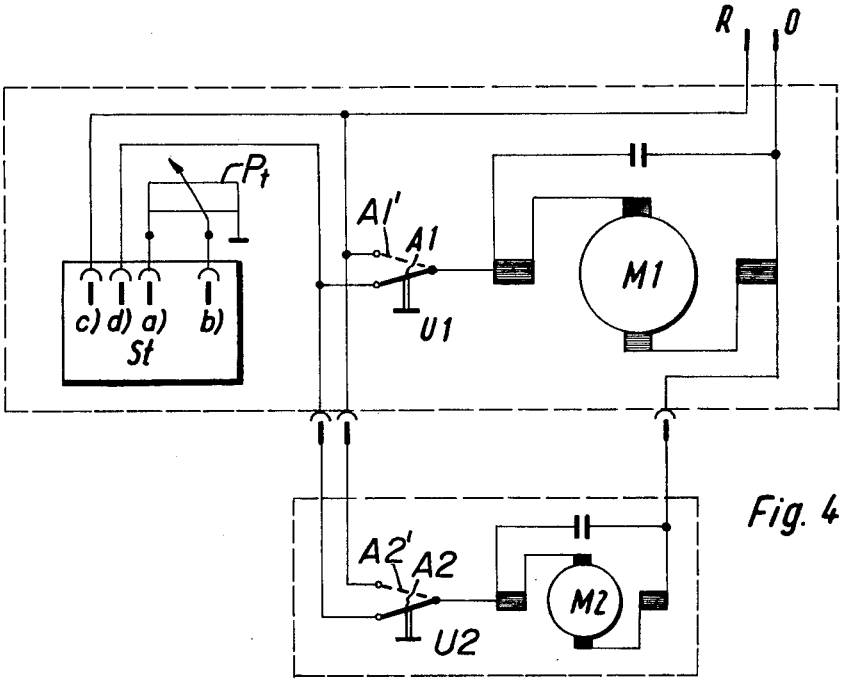
FIG. 4 is an electrical schematic showing a single rpm-setting device with selector switches to connect one or both of said vacuum-generating and roller-brush motors thereto.

A further embodiment of the present invention is shown in FIG. 4 wherein the motors M1 and M2 are connected through switches U1 and U2, respectively, to the rpm-setting means St as shown by switch arms A1 and A2 or to the full input voltage across terminals R and O as shown in phantom at A1' and A2'. Although switch arms A1 and A2 could be ganged together, in a preferred embodiment, they are independently operable so as to connect either, both or neither of the motors M1 and M2 to the rpm-setting means St. Again control Pt serves to manually adjust the voltage applied to the motors when the switches are in the position shown. Thus the speed of both motors could be controlled by control Pt or one motor could be left to operate at full capacity with the other motor controlled by control Pt or both motors could be operated at full capacity without any control. Thus the arrangement of FIG. 4 provides a great deal of flexibility in the vacuum cleaner's operation.

Figure 5:
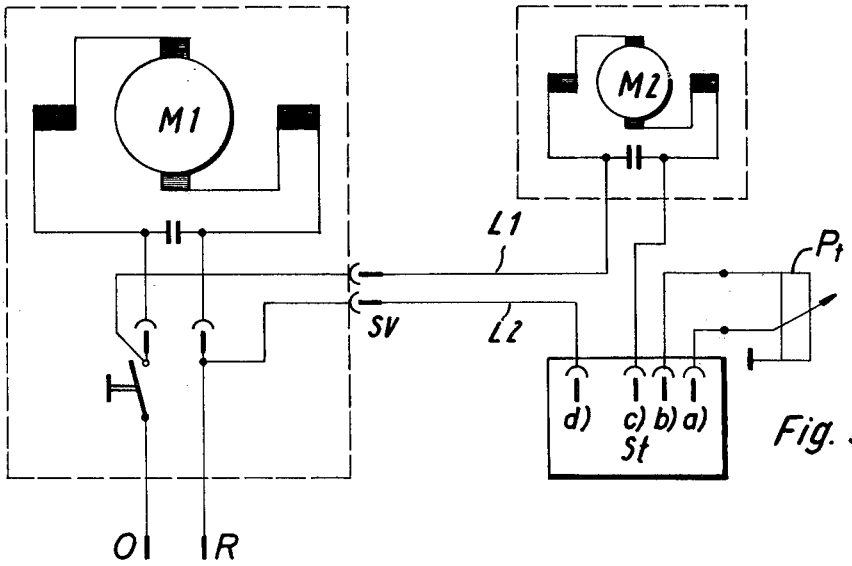
FIG. 5 is an electrical schematic showing an rpm-setting device which can be retrofitted onto existing vacuum cleaners.

FIG. 5 illustrates an embodiment which would be considered a modification to an existing vacuum cleaner. Here a two-terminal plug connection SV is provided to detachably connect the roller-brush motor to the vacuum-generating motor supply circuit. An rpm-setting means St with control Pt is connected in series with roller-brush motor M2 and would operate in the manner of the roller-brush motor M2 and speed-setting device St2 as discussed in FIG. 3. However, vacuum cleaners having their roller-brush motors connected to the supply voltage by means of a two-pole plug connection SV, can be easily retrofitted with a speed-setting control in accordance with the present invention.

Figure 6:
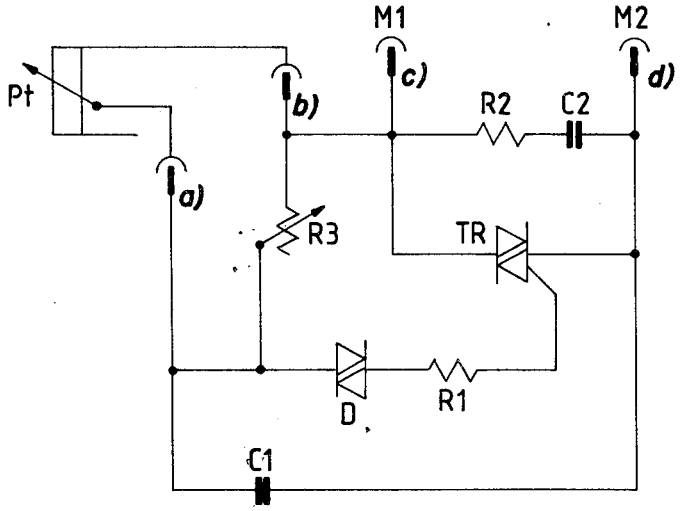
FIG. 6 is an electrical schematic showing the details of one embodiment of an rpm-setting device.

FIG. 6 shows the basic circuit diagram of the rpm-setting device St, which operates by the principle of a phase-shifting control. The potentiometer Pt is connected with the terminals a and b. A series circuit, comprising a diode ac switch D (a so-called "Diac"), a resistance R1 and a variable diode ac switch TR (a so-called "Triac") having three electrodes, is also connected with the terminals a and b. The series circuit D, R1 and TR is bridged by means of a variable resistance R3, one terminal of which is connected with the terminal b and its variable take-off with the terminal a and thus with the take-off of the potentiometer C. An RC element comprising a resistance R2 and a condenser C2 is connected across terminals c and d.

The setting of the potentiometer Pt determines the charging time of the condenser C1. This sets the point in time when the Diac D is conducting and thus firing the Triac TR. Without current flow in Diac D, the Triac TR is in the blocking state. By varying the resistance R3, the lower rpm limit of the motor M1 and M2, respectively, is set. The resistance R1 limits the firing current for the Triac TR. The RC element R2/C2 prevents the unintended firing of the Triac TR due to inductive charging of the motor connected with it.

In the embodiments illustrated in FIGS. 2–6, it may be advantageous to utilize a mechanical connection between the roller-brush and its associated drive motor M2 in order to reduce the rotational speed of the brush. The adjustment of the brush rotational speed can be made automatically as a function of the load on the brush when it is operating over a particular floor covering. Additionally, it may be advantageous to automatically shutoff the roller-brush motor M2 when a certain motor load current is reached, for example when the roller-brush becomes jammed or blocked. To accomplish this, a simple circuit breaker set in the roller-brush motor circuit may be used. It may also be advantageous to shutdown the vacuum-generating motor M1 when the roller-brush motor is shutoff in order to prevent continued operation without appropriate roller-brush action. Thus the circuit breaker could be incorporated so as to break the entire power supply to the vacuum cleaner as opposed to just breaking the power supply to the roller-brush motor. Additionally, instead of shutting off the vacuum-generating motor it may be of practical value just to indicate that the roller-brush motor M2 has been turned off by means of a suitable indicator device. Such a device could be the familiar circuit breaker which when in the nonconducting position has a push-button which projects outside the housing of the switch. With this arrangement, if one or both motors M1 and M2 have been switched off they can be restarted by merely resetting of the circuit breaker.

Although the invention has been described relative to a specific embodiment thereof, it is not so limited and many modifications and variations thereof will be readily apparent to those skilled in the art in light of the above teachings. It is therefore, to be understood that, within the scope of the appended claims, the invention may be practiced otherwise than as specifically described.

The embodiments of the invention in which an exclusive property of privilege is claimed are defined as follows:

1. A vacuum cleaner comprising:
a housing having a suction nozzle orifice;
a cylindrical brush rotatably mounted by said housing in said orifice;
a first motor drivingly connected to said brush for rotating said brush;
a suction motor connected to produce suction through said nozzle shaped orifice;
a power source;
an rpm control device connected to said power source; and
switch means for connecting said first motor and said suction motor individually either to said rpm control device or directly to said power source, whereby said first motor and said suction motor can be connected: in parallel with each other to said rpm control device; in parallel with each other directly to said power source; and separately with one of said motors connected to said rpm control device and the other of said motors connected directly to said power source.

2. The vacuum cleaner as set forth in claim 1, wherein said switch means comprises a first reversible switch connected to said first motor for selectively connecting said first motor either directly to said power source or to said rpm control device, and a second reversible switch connected to said suction motor for connecting said suction motor either directly to said power source, or to said rpm control device.

3. The vacuum cleaner as set forth in claim 1 or 2, wherein said rpm control device is mounted in said housing.

4. A vacuum cleaner comprising:
a housing having a suction nozzle orifice;
a roll shaped brush rotatably mounted by said housing in said orifice;
a first electric motor drivingly connected to said brush for rotating said brush;
a suction motor connected to a suction fan to produce suction through said suction nozzle orifice;
a power source;
a first rpm control device connected in series with said first motor, said series combination of said first rpm control device and said first motor being connected to said power source;
a second rpm control device connected in series with said suction motor, said series combination of said second rpm control device and said suction motor being connected to said power source, whereby said series combination of said first motor and said first rpm control device is connected in parallel to the series combination of said second rpm control device and said suction motor.

5. The vacuum cleaner as set forth in claim 4, wherein said rpm control devices are mounted in said housing.

* * * * *